United States Patent [19]

Welham

[11] Patent Number: 4,670,017

[45] Date of Patent: Jun. 2, 1987

[54] METHOD OF REDUCING CHROMIUM LEVELS IN EFFLUENT CHROMATE AFTERTREATMENT OF WOOL DYEINGS

[75] Inventor: Arthur C. Welham, Luddendenfoot, Great Britain

[73] Assignee: Sandoz Ltd., Basel, Switzerland

[21] Appl. No.: 777,044

[22] Filed: Sep. 17, 1985

[30] Foreign Application Priority Data

Sep. 17, 1984 [GB] United Kingdom ..... 8423421
Sep. 21, 1984 [GB] United Kingdom ..... 8423975

[51] Int. Cl.[4] ..... C09B 67/00

[52] U.S. Cl. ..... 8/598; 8/597; 8/550; 8/551; 8/552

[58] Field of Search ..... 524/195; 8/598, 551, 8/543, 552; 525/509

[56] References Cited

U.S. PATENT DOCUMENTS 4,410,652 10/1983 Robinson et al. ..... 8/496
4,439,203 3/1984 Runyon et al. ..... 8/924

FOREIGN PATENT DOCUMENTS 2122225 1/1984 United Kingdom .

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

A process for chrome aftertreatment comprising contacting the material to be chrome treated with a chromate in the presence of a composition comprising either ($A_1$) a product of reacting a mono- or poly-functional primary or secondary amine with cyanamide, dicyandiamide, guanidine or biguanidine, whereby up to 50 mole % of the cyanamide, dicyandiamide guanidine or biguanidine may be replaced with a dicarboxylic acid or mono- or di-esters thereof, the product containing reactive hydrogen bound to nitrogen; or ($A_2$) the product of reacting $A_1$ above with an N-methylol derivative of a urea, melamine, guanamine, triazinone, urone, carbamate or acid amide optionally in the presence of a catalyst for the crosslinking of N-methylol compounds of the type above; or ($A_3$) the product of $A_1$ above with epihalohydrin or a precursor thereof; and (B) a reducing carbohydrate.

22 Claims, No Drawings

METHOD OF REDUCING CHROMIUM LEVELS IN EFFLUENT CHROMATE AFTERTREATMENT OF WOOL DYEINGS

The invention relates to reducing chrome residues in the dyeing effluents of chrome aftertreatment processes in particular for wool dyeings.

Dur to their economy and ability to produce dyeings of high wet-fastness, chrome (mordant) dyes have been important in wool dyeings for the last 100 years.

Of particular importance is the chrome aftertreatment in which a chromate compound is applied to the substrate so as to allow high wet fastness to be obtained with any class of wool dye and also to assist in developing the shade of dye required. However, in recent years the levels of chromium, particularly Cr VI discharged in the effluent from dyehouses, has been high. In many countries limits have been set for discharged chromium in the effluent. Typically these are around 2 ppm of Cr VI and 5 ppm of total chromium.

In many cases it is possible to achieve these levels by using a minimal chromate concentration and maintaining a pH of about 3.5 during chroming. The present invention however considerably reduces the chromium levels in chrome aftertreatment effluent.

According to the invention there is provided a process for chrome aftertreatment comprising contacting the material to be chrome-treated with a chromate in the presence of a composition comprising Product A which is either ($A_1$) a product of reacting a mono- or poly-functional primary or secondary amine with cyanamide, dicyandiamide, guanidine or biguanidine, whereby up to 50 mole % of the cyanamide, dicyandiamide, guanidine or biguanidine may be replaced with a dicarboxylic acid or mono- or di-esters thereof, the product containing reactive hydrogen bound to nitrogen; or ($A_2$) the product of reacting $A_1$ above with an N-methylol derivative of a urea, melamine, guanamine, triazinone, urone, carbamate or acid amide optionally in the presence of a catalyst for the crosslinking of N-methylol compounds of the type above; or ($A_3$) the product of $A_1$ above with epihalohydrin or a precursor thereof; and (B) a reducing carbohydrate.

The product $A_1$ is preferably a product of reacting a compound of formula I $$RRN—(Z—X)_n—NRR \quad (I)$$

where each R independently, is hydrogen, $C_{1-10}$alkyl of $C_{1-10}$-alkyl monosubstituted by OH, $C_{1-4}$alkoxy or CN; n is from 0 to 100 inclusive; each Z independently (when n is greater than 0) is $C_{1-4}$alkylene or hydroxyalkylene; each X independently (when n is greater than 0) is —O—, —S— or —NR—, with the proviso that the amine of formula I has at least one reactive —NH— or —$NH_2$ group, with cyanamide, dicyandiamide or guanidine.

In this specification any halo group is preferably chloro.

Preferably the temperature range of the aftertreatment process is 80°-100° C. Preferably the pH of the process is 2 to 5.

Preferably Product A is either $A_1'$ the reaction product of diethylenetriamine or triethylenetetramine with dicyandiamide; or $A_2'$ the reaction product of (a) the reaction product of diethylenetriamine or triethylenetetraamine with dicyandiamide; and (b) N,N dimethyloldihydroxyethylene urea, optionally in the presence of magnesium chloride; or $A_3'$ the reaction product of (a) the product of reaction diethylenetriamine or triethylenetetraamine with dicyandiamide and (b) epichlorohydrin.

Preferably component (B) above is a reducing sugar, more preferably dextrose. By reducing sogos is meant mono, di or polysaccharide.

Preferably the ratio of product (A) to reducing carbohydrate B is in the range 1.5:1 to 1:1.5. More preferably the ratio of (A) to (B) is 1:1.

Products $A_1$ and $A_2$ are described in British Pat. No. 2,070,006 B and Products $A_3$ are described in British Published Patent Application No. 2,142,642 A, the contents of which are incorporated herein by reference. U.S. Pat. No. 4,410,652; U.S. Ser. No. 625,812 filed June 28, 1984 and U.S. Pat. No. 4,439,203 are incorporated by reference.

Preferably the amount of the composition comprising A+B is 10 to 40% of chromate present, more preferably about 25%.

Preferred chromates are the dichromates, more preferably potassium dichromate or sodium dichromate, most preferably the latter.

In the process of the invention auxiliaries such as levelling agents (of which Lyogen TP is an example) or suitable products to overcome tippy or skittery dyeings may be used. Wet fastness properties of dyeings of the invention may be improved by ammonia aftertreatment.

Preferred substrates are wool, more preferably shetland wool, lambswool or botany wool, which may be shrink resist treated e.g. by chlorination or chlorine hercosett, silk or synthetic polyamide, e.g. nylong.

Further, according to the invention there is provided a composition comprising Product A which is either ($A_1$) a product of reacting a mono- or poly-functional primary or secondary amine with cyanamide, dicyandiamide, guanidine or biguanidine, whereby up to 50 mole % of the cyanamide, dicyandiamide, guanidine or biguanidine may be replaced with a dicarboxylic acid or mono- or di-esters thereof, the product containing reactive hydrogen bound to nitrogen; or ($A_2$) the product of reacting $A_1$ above with an N-methylol derivative of a urea, melamine, guanamine, triazinone, urone, carbamate or acid amide optionally in the presence of a catalyst for the crosslinking of N-methylol compounds of the type above; or ($A_3$) the product of $A_1$ above with epihalohydrin or a precursor thereof; and (B) a reducing carbohydrate.

The invention will now be illustrated by the following Examples in which all percentages are by dry weight of substrate being dyed and all temperatures are in degrees Centigrade unless indicated to the contrary.

EXAMPLES 1 AND 2

1. Conventional procedure

An amount of dyestuff (given in the Table below) is added to the dyebath set at 50° with 2% acetic acid and 2% Lyogen TP in a liquor to goods ratio 10:1.

A loose shetland wool substrate is added and dyeing is carried out for 10 minutes at 50° after which the bath is raised to the boil (about 98°) for 15 minutes. 1% of formic acid is then added and the dyebath is cooled to 70°, with the pH being adjusted to 3.5 with formic acid.

An amount of sodium dichromate (given in the Table below) is added and the temperature of the dyebath is raised to 98°. This is maintained at this temperature for 30 minutes, after which the bath is drained and the substrate is rinsed and dried.

2. New Procedure

The method of the conventional procedure is followed except that an amount of 25% of the amount of dichromate added of a 1:1 mixture of dextrose and the reaction product of diethylenetriamine and dicyanodiamide is added for the last 10 minutes of the 30 minutes chroming time (i.e. after the sodium dichromate has been added). The amount of Cr VI and Cr III remaining in the effluent from each procedure is given in the Table below.

TABLE

| | Example 1 | Example 2 |
|---|---|---|
| Amount and Dyestuff used | 25% of Dye 1 | 3% of Dye 2 |
| Amount of Sodium dichromate used | 1% | 0.75% |
| (A) Conventional procedure | | |
| (i) Amount of Cr VI remaining in the exhausted bath | 17.50 ppm | 4.46 ppm |
| (ii) Amount of Cr III remaining in the exhausted bath | 10.1 ppm | 3.6 ppm |
| (B) New procedure | | |
| (i) Amount of Cr VI remaining in the exhausted bath | 0.039 ppm | 0.015 ppm |
| (ii) Amount of Cr III remaining in the exhausted bath | 1.0 ppm | 1.2 ppm |

Dye 1 is a composition comprising:
17.5 parts C.I. Acid Green 106
20.0 parts C.I. Mordant Yellow 34, 150%
17.0 parts C.I. Mordant Blue 69
19.2 parts C.I. Mordant Blue 1, 200%
11.2 parts C.I. Mordant Violet 60
5.6 parts C.I. Mordant Violet 28 300%
19.5 parts Dextrine.

Dye 2 is a composition comprising:
32.0 parts C.I. Mordant Violet 60;
48.0 parts C.I. Mordant Violet 28;
9.2 parts C.I. Mordant Blue 1 200%;
8.0 parts Dextrine.

What is claimed is:

1. In a process wherein a textile substrate is dyed with a wool dye and the dyed substrate is aftertreated with a chromate compound, the improvement which comprises contacting the dyed substrate with the chromate compound in the presence of a composition comprising (B) a reducing carbohydrate and (A) a product selected from the group consisting of ($A_1$) a product of reacting a mono- or poly-functional primary or secondary amine with cyanamide, dicyandiamide, guanidine or bi-guanidine, whereby up to 50 mole % of the cyanamide, dicyandiamide, guanidine or biguanidine may be replaced with a dicarboxylic acid or mono- or di-esters thereof, the product containing reactive hydrogen bound to nitrogen;

($A_2$) the product of reacting $A_1$ above with an N-methylol derivative of a urea, melamine, guanamine, triazinone, urone, carbamate or acid amide optionally in the presence of a catalyst for the crosslinking of N-methylol compounds of the type above; and ($A_3$) the product of reacting $A_1$ above and epihalohydrin or a precursor thereof.

2. A process according to claim 1 wherein the reducing carbohydrate is a reducing sugar and the substrate is wool, silk or nylon.

3. A process according to claim 2 in which product A is either $A_1'$ the reaction product of diethylenetriamine or triethylenetetraamine with dicyandiamide; or $A_2'$ the reaction product of (a) the product of reacting diethylenetriamine or triethylenetetraamine with dicyandiamide and (b) N,N-dimethylol dihydroxyethylene urea optionally in the presence of magnesium chloride; or $A_3'$ the reaction product of (a) the product of reacting diethylenetriamine or triethylenetetramine with dicyandiamide and (b) epichlorohydrin.

4. A process according to claim 2 in which the reducing carbohydrate is dextrose.

5. A process according to claim 3 wherein the reducing carbohydrate is dextrose.

6. A process according to claim 3 wherein the aftertreatment is effected at a temperature of 80°–100° C. and a pH of 2–5.

7. A process according to claim 2 wherein the aftertreatment is effected at a temperature of 80°–100° C. and a pH of 2–5.

8. A process according to claim 3 wherein the ratio of (A) to (B) is in the range of 1.5:1 to 1:1.5.

9. A process according to claim 2 wherein the ratio of (A):(B) is in the range of 1.5:1 to 1:1.5.

10. A process according to claim 6 wherein the ratio of (A):(B) is in the range of 1.5:1 to 1:1.5.

11. A process according to claim 7 wherein the ratio of (A):(B) is in the range of 1.5:1 to 1:1.5.

12. A process according to claim 3 wherein the amount of composition comprising (A) and (B) is 10 to 40% of the chromate.

13. A process according to claim 2 wherein the amount of composition comprising (A) and (B) is 10 to 40% of the chromate.

14. A process according to claim 8 wherein the amount of composition comprising (A) and (B) is 10 to 40% of the chromate.

15. A process according to claim 11 wherein the amount of composition comprising (A) and (B) is 10 to 40% of the chromate.

16. A process according to claim 2 wherein the chromate compound is potassium dichromate or sodium dichromate.

17. A process according to claim 14 wherein the chromate compound is potassium dichromate or sodium dichromate.

18. A process according to claim 15 wherein the chromate compound is potassium dichromate or sodium dichromate.

19. A chrome treated textile substrate aftertreated by a process according to claim 2.

20. A substrate according to claim 19 selected from wool, silk and synthetic polyamide.

21. A process according to claim 3 wherein product A is the reaction product of diethylenetriamine with dicyandiamide.

22. A process according to claim 18 wherein product A is the reaction product of diethylenetriamine with dicyandiamide.

* * * * *